United States Patent [19]

Straathof et al.

[11] Patent Number: 4,767,547

[45] **Date of Patent: * Aug. 30, 1988**

[54] BIODEGRADABLE FABRIC SOFTENERS

[75] Inventors: Theodericus J. Straathof, Breda, Netherlands; Axel König, Wemmel, Belgium

[73] Assignee: The Procter & Gamble Company, Cincinnati, Ohio

[ * ] Notice: The portion of the term of this patent subsequent to Apr. 28, 2004 has been disclaimed.

[21] Appl. No.: 31,080

[22] Filed: Mar. 26, 1987

[30] Foreign Application Priority Data

Apr. 2, 1986 [GB] United Kingdom ..... 8608033

[51] Int. Cl.[4] ..... D06M 11/00

[52] U.S. Cl. ..... 252/8.8; 252/8.9

[58] Field of Search ..... 252/8.8, 8.9, 8.75

[56] References Cited

U.S. PATENT DOCUMENTS

| | | | |
|---|---|---|---|
| 4,339,391 | 7/1982 | Hoffmann | 260/401 |
| 4,429,859 | 2/1984 | Steiner et al. | 252/8.8 |
| 4,456,554 | 6/1984 | Walz | 260/403 |
| 4,661,267 | 4/1987 | Dekker | 252/8.8 |

FOREIGN PATENT DOCUMENTS

| | | |
|---|---|---|
| 21431 | 7/1979 | European Pat. Off. . |
| 1593921 | 7/1970 | France . |

*Primary Examiner*—John F. Niebling
*Assistant Examiner*—Isabelle Rodriquez
*Attorney, Agent, or Firm*—Robert B. Aylor; Richard C. Witte

[57] ABSTRACT

Fabric softening compositions which are rapidly biodegradable and particularly shelf stable are disclosed. These compositions contain a specific quaternary ammonium, and are formulated in a narrowly defined pH range.

12 Claims, No Drawings

BIODEGRADABLE FABRIC SOFTENERS

TECHNICAL FIELD

The present invention relates to rapidly biodegradable fabric softening compositions which exhibit excellent hydrolytic stability upon storage. More particularly, the invention relates to aqueous dispersions of rapidly biodegradable quaternary ammonium compounds suitable as rinse-added fabric softener compositions, which are formulated at a very specific pH range in order to ensure maximum hydrolytic stability.

BACKGROUND OF THE INVENTION

Rinse-added fabric softener compositions are well-known. Typically, such compositions contain a water-insoluble quaternary-ammonium fabric softening agent. Commercially available fabric softening compositions are basically aqueous dispersions of the water-insoluble quaternary compounds. Quaternary ammonium compounds with long chain alk(en)yl groups interrupted by carboxy groups (i.e., biodegradable quaternary ammonium) are known, from e.g. French Patent No. 1.593.921. Concentrated softening compositions containing such rapidly biodegradable quaternary ammonium are disclosed in European Patent No. 0 040 562.

However, since these compounds are intended to be marketed as aqueous dispersions, and since the rapidly biodegradable quaternary ammoniums are more subject to hydrolysis than the conventional (DTDMAC-type) cationic softening agents, such rapidly biodegradable softening compositions can enounter hydrolytic stability problems upon prolonged shelf storage.

It is therefore an object of the present invention to provide aqueous softening compositions containing rapidly biodegradable quaternary ammonium compounds, which are sufficiently shelf stable.

Indeed, it has been found that, by keeping the pH of the compositions herein in a certain range, lower than what is currently used in rinse-added softening compositions, excellent hydrolytic stability is ensured on prolonged shelf storage.

SUMMARY OF THE INVENTION

The present invention relates to aqueous fabric softening compositions containing from 1% to 80%, preferably from 2% to 29%, by weight, of a rapidly biodegradable quaternary ammonium compound of the formula:

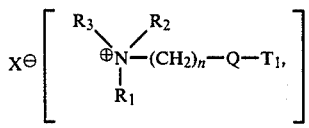

(I)

or

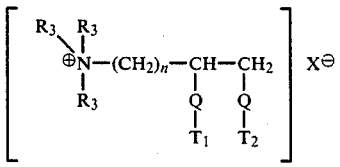

(II)

-continued

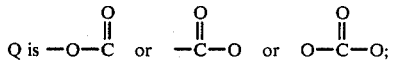

$R_1$ is $(CH_2)_n$—Q—$T_2$ or $T_3$;

$R_2$ is $(CH_2)_n$—Q—$T_4$ or $T_5$ or $R_3$;

$R_3$ is $C_1$–$C_4$ alkyl;

$T_1$, $T_2$, $T_3$, $T_4$, $T_5$ are (the same or different) $C_{12}$–$C_{22}$ alkyl or alkenyl;

n is an integer from 1 to 4; and $X^{\ominus}$ is a softener-compatible anion.

Together with conventional matrix components, and optionally additional softening agents, the pH of the composition being of from 2.5 to 4.2, preferably 3.4 to 4.2, when diluted to a concentration of 0.5% to 1% of the rapidly biodegradable quaternary ammonium in water, at 20° C.

DETAILED DESCRIPTION OF THE INVENTION

The rapidly biodegradable quaternary ammonium compounds

The rapidly biodegradable quaternary ammonium compounds have the formula (I) or (II), above. Preferred compounds are those wherein n=1 or 2 and $R_3$ is methyl. Compounds of Formula (I) wherein $R_1$ is $(CH_2)_n$—Q—$T_2$ and $R_2$ is $(CH_2)_n$—Q—$T_4$ (i.e., quaternary ammonium compounds having three long chains) preferably have at least one unsaturated long chain. Of these, the compounds having all three long chains with one or more double bonds are preferred.

The alkyl, or alkenyl, chain $T_1$, $T_2$, $T_3$, $T_4$, $T_5$ must contain at least 12 carbon atoms, preferably at least 16 carbon atoms. The chain may be straight or branched. Unsaturated (alkenyl) chains have been found to impart better rewettability properties to fabrics treated with the softener compositions. Hence, compounds containing such unsaturated chains are preferred in fabric softening compositions intended for use in circumstances where the rewettability properties of the treated fabric is an issue.

Tallow is a convenient and inexpensive source of long chain alkyl and alkenyl material. Compounds wherein $T_1$, $T_2$, $T_3$, $T_4$, $T_5$ represents the mixture of long chain materials typical for tallow are particularly preferred.

Specific examples of rapidly biodegradable quaternary ammonium compounds suitable for use in the aqueous fabric softening compositions herein include:

(1) N,N-di(tallowoyl-oxy-ethyl)-N,N-dimethyl ammonium chloride;

(2) N,N-di(2-tallowyloxy-2-oxo-ethyl)-N,N-dimethyl ammonium chloride;

(3) N,N-di(2-tallowyloxyethylcarbonyloxyethyl)-N,N-dimethyl ammonium chloride;

(4) N-(2-tallowoyloxy-2-ethyl)-N-(2-tallowyloxy-2-oxo-ethyl)-N,N-dimethyl ammonium chloride;

(5) N,N,N-tri(tallowyl-oxy-ethyl)-N-methyl ammonium chloride;

(6) N-(2-tallowyloxy-2-oxoethyl)-N-(tallowyl-N,N-dimethylammonium chloride; and (7) 1,2-ditallowyl oxy-3-trimethylammoniopropane chloride.

Of these, compounds 1–6 are examples of compounds of Formula (I); compound 7 is a compound of Formula (II).

Particularly preferred is N,N-di(tallowoyl-oxyethyl)-N,N-dimethyl ammonium chloride.

Other examples of suitable quaternary ammoniums of formula (I) and (II) are obtained by e.g., replacing "tallowyl" in the above compounds with, for example, cocoyl, palmoyl, lauryl, oleyl, stearyl, palmityl, or the like;

replacing "methyl" in the above compounds with ethyl, propyl, isopropyl, butyl, isobutyl or t-butyl;

replacing "chloride" in the above compounds with bromide, methylsulfate, formate, sulfate, nitrate, and the like.

In fact, the anion is merely present as a counterion of the positively charged quaternary ammonium compound. The nature of the counterion is not critical at all to the practice of the present invention. The scope of this invention is not considered limited to any particular anion.

The compounds herein can be prepared by standard esterification and quaternization reactions, using readily available starting materials.

For example, above compound (1) is prepared by reacting tallow fatty acid with N-methyl-N,N-diethanolamine in xylene at 130°–140° C., whereby water formed in the reaction is removed by azeotropic distillation. The ester thus formed is quaternized with methyl chloride in usual fashion.

Similarly, compound (2) is prepared by reacting iminodiacetic acid with tallow alcohol and subsequent quaternization.

Compound (3) is synthesized by reacting tallow alcohol chloro formate with N-methyldiethanol amine and quaternizing with methyl chloride in usual fashion The rapidly biodegradable quaternary ammonium compounds herein are present at levels of from 1% to 80%, preferably from 2% to 25% by weight of the composition. They can be used in aqueous fabric softening compositions to fully or partially replace conventional, less rapidly biodegradable fabric softening ingredients; therefore, the compositions of the invention optionally contain additional softening agents as will be seen hereinafter.

The pH

The pH of the compositions herein is an essential parameter of the present invention. Indeed, it influences the hydrolytic stability of the rapidly biodegradable quaternary ammonium compounds, especially in prolonged storage conditions.

The pH, as defined in the present context, is measured in compositions which have been diluted with de-ionized water, at 20° C. The dilution of the compositions whose pH is measured must be such that the rapidly biodegradable quaternary ammonium compound is present at a concentration of 0.5% to 1%. For optimum hydrolytic stability of the compositions, the pH, measured in the above-mentioned conditions, must be in the range of from 2.5 to 4.2, preferably 3.4 to 4.2.

The pH of the compositions herein is regulated by the addition of a Bronstedt acid.

Examples of suitable acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, methylsulfonic and ethylsulfonic acid. Preferred acids are hydrochloric, phosphoric, formic, methylsulfonic acid, and benzoic acids.

Fully formulated fabric softening compositions preferably contain, in addition to the rapidly biodegradable quaternary ammonium compound of Formula I or II herein, one or more of the following optional ingredients:

Conventional quaternary ammonium salt

As mentioned before, the rapidly biodegradable compounds may be used as a partial replacement of conventional fabric softening active materials, in which case the fabric softening composition further comprises a conventional di(higher alkyl) quaternary ammonium softening agent.

By "higher alkyl" as used in the context of the quaternary ammonium salts herein is meant alkyl groups having from 8 to 30 carbon atoms, preferably from 11 to 22 carbon atoms. Examples of such conventional quaternary ammonium salts include (i) acyclic quaternary ammonium salts having the formula:

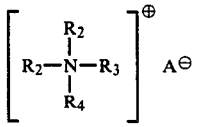

wherein $R_2$ is an acyclic aliphatic $C_{15}$–$C_{22}$ hydrocarbon group. $R_3$ is a $C_1$–$C_4$ saturated alkyl or hydroxyalkyl group, $R_4$ is selected from $R_2$ and $R_3$, and A is an anion.

(ii) diamido quaternary ammonium salts having the formula:

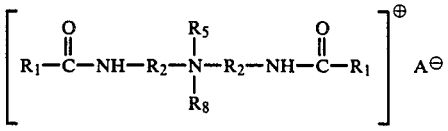

wherein $R_1$ is an acyclic aliphatic $C_{15}$–$C_{21}$ hydrocarbon group, $R_2$ is a divalent alkylene group having 1 to 3 carbon atoms, $R_5$ and $R_8$ are $C_1$–$C_4$ saturated alkyl or hydroxyalkyl groups, and $A^{\ominus}$ is an anion:

(iii) diamido alkoxylated quaternary ammonium salts having the formula:

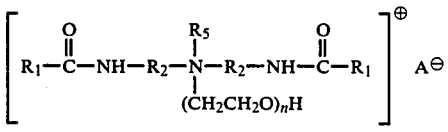

wherein n is equal to 1 to about 5, and $R_1$, $R_2$, $R_5$ and $A^{\ominus}$ are as defined above:

(iv) quaternary imidazolinium compounds.

Examples of Component (i) are the well-known dialkyldimethylammoniums salts such as ditallowdimethylammonium chloride, ditallowdimethylammonium methylsulfate, di(hydrogenated tallow)dimethylammonium chloride, dibehenyldimethylammonium chloride.

Examples of Component (ii) are methylbis(tallowamidoethyl)(2-hydroxyethyl)ammonium methylsulfate and methylbis(hydrogenated tallowamidoethyl)(2-hydroxyethyl)ammonium methylsulfate wherein $R_1$ is an acyclic aliphatic $C_{15}$–$C_{17}$ hydrocarbon group, $R_2$ is an ethylene group, $R_5$ is a methyl group, $R_8$ is a hydroxyalkyl group and A is a methylsulfate anion; these materials are available from Sherex Chemical Company under the trade names Varisoft® 222 and Varisoft® 110, respectively.

Examples of (iv) are 1-methyl-1-tallowamino-ethyl-2-tallowimidazolinium methylsulfate and 1-methyl-1-(hydrogenated tallowamidoethyl)-methylsulfate.

Typically, the weight ratio rapidly biodegradable: conventional quaternary ammonium compound is in the range from 1:10 to 10:1

Cation-active amines

The compositions herein optionally comprise cation-active amines, namely primary, secondary and tertiary amines having, at least, one straight-chain organic group of from 12 to 22 carbon atoms. Preferred amines of this class are ethoxyamines, such as monotallow-dipolyethoxyamine, having a total of 2 to 30 ethoxy-groups per molecule. Suitable are also diamines such as tallow-N,N',N'-tris(2-hydroxyethyl)-1,3-propylenediamine, or $C_{16-18}$-alkyl-N-bis(2-hydroxyethyl)amines.

Examples of the above compounds are those sold under the trade name GENAMIN C, S, O and T, by Hoechst.

Di-(higher alkyl)cyclic amine

The compositions herein optionally comprise from 1% to 40% by weight of the composition of a di(higher alkyl)cyclic amine of formula IV

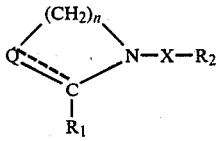

Formula (IV)

wherein n is 2 or 3, preferably 2; $R_1$ and $R_2$ are, independently, a $C_8$–$C_{30}$ alkyl or alkenyl, preferably $C_{11}$–$C_{22}$ alkyl, more preferably $C_{15}$–$C_{18}$ alkyl, or mixtures of such alkyl radicals. Examples of such mixtures are the alkyl radicals obtained from coconut oil, "soft" (non-hardened) tallow, and hardened tallow. Q is CH or N, preferably N. X is $$-R_4-T-\underset{\underset{O}{\|}}{C}-$$

wherein T is O or $NR_5$, $R_5$ being H or $C_1$–$C_4$ alkyl, preferably H, and $R_4$ is a divalent $C_1$–$C_3$ alkylene group or $(C_2H_4O)_m$, wherein m is an number of from 1 to 8; or X is $R_4$.

Optional silicone component

The fabric softening composition optionally contains an aqueous emulsion of a predominantly linear polydialkyl or alkyl, aryl siloxane in which the alkyl groups can have from one to five carbon atoms and may be wholly or partially fluorinated. Suitable silicones are polydimethyl siloxanes having a viscosity at 25° C. in the range from 100 to 100,000 centistokes, preferably in the range from 1000 to 12,000 centistokes.

It has been found that the ionic charge characteristics of the silicone as used in the combination are important in determing both the extent of deposition and the evenness of distribution of the silicone and hence the properties of a fabric treated therewith.

Silicones having cationic character show an enhanced tendency to deposit. Silicones found to be of value in providing fabric feel benefits have a predominantly linear character and are preferbly polydialkyl siloxanes in which the alkyl group is most commonly methyl. Such silicone polymers are frequently manufactured commercially by emulsion polymerisation using a strong acid or strong alkali catalyst in the presence of a nonionic or mixed nonionic-anionic emulsifier system.

In the present invention, the optional silicone component embraces a silicone of cationic character which is defined as being one of (a) a predominantly linear di $C_1$–$C_5$ alkyl or $C_1$–alkyl, aryl siloxane, prepared by emulsion polymerisation using a cationic surfactant as emulsifier;

(b) an alpha-omega-di quaternised di $C_1$–$C_5$ alkyl or $C_1$–$C_5$ alkyl, aryl siloxane polymer or (c) an amino-functional di $C_1$–$C_5$ alkyl or alkyl aryl siloxane polymer in which the amino group may be substituted and may be quaternised and in which the degree of substitution (d.s.) lies in the range 0.0001 to 0.1, preferably 01–0.075.

provided that the viscosity at 25° C. of the silicone is from 100 to 100,000 cs.

The fabric softening compositions herein may contain up to 10%, preferably from 0.1% to 5%, of the silicone component.

Soil Release Agent

Optionally, the composition herein contain from 0.1% to 10%, preferably from 0.2% to 5%, of a soil release agent. Preferably, such a soil release agent of the present composition is a polymer. Polymeric soil release agents useful in the present invention include hydroxyether cellulosic polymers, copolymeric blocks of terephthalate and polyethylene oxide or polypropylene oxide, and cationic guar gums, and the like.

The cellulosic derivatives that are functional as soil release agents may be characterized as certain hydroxyethers of cellulose such as Methocel® (Dow); also, certain cationic cellulose ether derivatives such as Polymer JR-125®, JR-400®, and JR-30M® (Union Carbide).

Other effective soil release agents are cationic guar gums such as Jaguar Plus® (Stein Hall) and Gendrive 458® (General Mills).

A preferred fabric conditioning composition has a polymeric soil release agent selected from the group consisting of methyl cellulose, hydroxypropyl methylcellulose, or hydroxybutyl methylcellulose, said cellulosic polymer having a viscosity in 2% aqueous solution at 20° C. of 15 to 75,000 centipoise.

A more preferred soil release agent is a copolymer having blocks of terephthalate and polyethylene oxide. More specifically, these polymers are comprised of repeating units of ethylene terephthalate and polyethylene oxide terephthalate at a molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

Another preferred polymeric soil release agent is a crystallizable polyester with repeat units of ethylene terephthalate units containing 10–15% by weight of ethylene terephthalate units together with 90–50% by weight of polyoxyethylene terephthalate units, derived from a polyoxyethylene glycol of average molecular weight 300–6,000, and the molar ratio of ethylene terephthalate units to polyoxyethylene terephthalate units in the crystallizable polymeric compound is between 2:1 and 6:1. Examples of this polymer include the commercially available material Zelcon® 4780 (from Dupont) and Milease® T (from ICI).

Highly preferred soil release agents are polymers of the generic formula:

$$X-(OCH_2CH_2)_n(O-\overset{O}{\overset{\|}{C}}-R^1-\overset{O}{\overset{\|}{C}}-OR^2)_u(O-\overset{O}{\overset{\|}{C}}-R^1-\overset{O}{\overset{\|}{C}}-O)(CH_2CH_2O)_n-X \qquad \text{Formula V}$$

in which X can be any suitable capping group, with each X being selected from the group consisting of H, and alkyl or acyl groups containing from 1 to about 4 carbon atoms. n is selected for water solubility and generally is from about 6 to about 113, preferably from about 10 to about 50. u is critical to formulation in a liquid composition having a relatively high ionic strength. There should be very little material in which u is greater than 10. Furthermore there should be at least 20%, preferably at least 40% of material in which u ranges from 3 to 5.

The $R^1$ moieties are essentially 1,4-phenylene moieties. As used herein, the term "the $R^1$ moieties are essentially 1,4-phenylene moieties" refers to compounds where the $R^1$ moieties consist entirely of 1,4-phenylene moieties, or are partially substituted with other arylene or alkarylene moieties, alkylene moieties, alkenylene moieties, or mixtures thereof. Arylene and alkarylene moieties which can be partially substituted for 1,4-phenylene include 1,3-phenylene, 1,2-phenylene, 1,8-naphtylene, 1,4-naphtylene, 2,2-biphenylene, 4,4-biphenylene and mixtures thereof. Alkylene and alkenylene moieties which can be partially substituted include ethylene, 1,2-propylene, 1,4-butylene, 1,5-pentylene, 1,6-hexamethylene, 1,7-heptamethylene, 1,8-octamethylene, 1,4-cyclohexylene, and mixtures thereof.

For the $R^1$ moieties, the degree of partial substitution with moieties other than 1,4-phenylene should be such that the soil release properties of the compound are not adversely affected to any great extent. Generally, the degree of partial substitution which can be tolerated will depend upon the backbone length of the compound, i.e., longer backbones can have greater partial substitution for 1,4-phenylene moieties. Usually, compounds where the $R^1$ comprise from about 50 to 100% 1,4-phenylene moieties (from 0 to about 50% moieties other than 1,4-phenylene) have adequate soil release activity. For example, polyesters made according to the present invention with a 40:60 mole ratio of isophtalic (1;3-phenylene) to terephthalic (1,4-phenylene) acid have adequate soil release activity. However, because most polyesters used in fiber making comprise ethylene terephtalate units, it is usually desirable to minimize the degree of partial substitution with moieties other than 1,4-phenylene for best soil release activity. Preferably, the $R^1$ moieties consist entirely of (i.e., comprise 100%) 1,4-phenylene moieties, i.e. each $R^1$ moiety is 1,4-phenylene. (Irrespective of the mechanism of action, it is surprising that the soil release polymers do show excellent benefits on fabrics other than polyester fabrics and the compositions herein are designed to clean all manner of fabrics and textiles.)

For the $R^2$ moieties, suitable ethylen or substituted ethylene moieties include ethylene, 1,2-propylene, 1,2-butylene, 1,2-hexylene, 3-methoxy-1,2-propylene and mixtures thereof. Preferably, the $R^2$ moieties are essentially ethylene moieties, 1,2-propylene moieties or mixture thereof. Inclusion of a greater percentage of ethylene moieties tends to improve the soil release activity of the compounds. Surprisingly, inclusion of a greater percentage of 1,2-propylene moieties tends to improve the water solubility of the compounds.

For this invention, the use of 1,2-propylene moieties or a similar branched equivalent is desirable for incorporation of any substantial part of the soil release component in the liquid fabric softener compositions. Preferably, from about 75% to about 100%, more preferably from about 90% to about 100% of the $R^2$ moieties are 1,2-propylene moieties.

The value for each n is at least about 6, but is preferably at least about 10. The value for each n usually ranges from about 12 to about 113. Typically, the value for each n is in the range of from about 12 to about 43.

A preferred process for making the preferred soil release component comprises the step of extracting a polymer having a normal distribution in which a substantial portion comprises a material in which u is greater than 6 with essentially anhydrous ethanol at low temperatures, e.g. from about 10° C. to about 15° C. The ethanol soluble fraction is substantially free of the longer polymers.

Organic solvent

The compositions of the present invention can be formulated without the use of any organic solvent. However, the presence of organic solvents (for example, low molecular weight, water miscible aliphatic alcohols,) does not harm the storage stability, the viscosity, or the softening performance of the compositions of this invention.

Typically, quaternary ammonium salts will be obtained from a supplier of bulk chemicals in solid form or as a solution in an organic solvent, e.g., isopropanol. There is no need, whatsoever, to remove such a solvent in making the compositions of this invention. Indeed, additional solvent may be added, if this is deemed desirable.

Optional Nonionics

The compositions optionally contain nonionics as have been disclosed for use in softener compositions. Such nonionics and their usage levels, have been disclosed in U.S. Pat. No. 4,454,049, issued June 12, 1984 to Mac Gilp et al., the disclosures of which are incorporated herein by reference.

Specific examples of nonionics suitable for the compositions herein include glycerol esters (e.g., glycerol monostearate), fatty alcohols (e.g., stearyl alcohol), and alkoxylated fatty alcohols. The nonionic, if used, is typically used at a level in the range of from 0.5–10% by weight of the composition.

Other Optional Ingredients

In order to further improve the stability of the compositions herein, and further adjust their viscosities, these compositions can contain relatively small amounts of electrolyte. A highly preferred electrolyte is $CaCl_2$.

The compositions herein can optionally contain other ingredients known to be suitable for use in textile softeners. Such adjuvents include perfumes, preservatives, germicides, colorants, dyes, fungicides, stabilizers, brighteners and opacifiers. These adjuvents, if used, are normally added at their conventional levels. However, in the case of composition ingredients utilized for a fabric treatment effect, e.g., perfumes, these materials can be added at higher than normal levels, corresponding to the degree of concentration of the product.

EXAMPLE 1

The following procedure was used to determine the hydrolytic stability of the compositions.

A melt of N-N-di(tallowoyl-oxy-ethyl)-N-N-dimethyl ammonium chloride (1) (about 65° C.) was injected into a waterseat (de-ionized water) of approximately 60 C. while mixing with a baffled stirrer. The pH of finished products (at 20° C.) was varied by adding Hydrochloric Acid or Sodium Hydroxyde to the waterseat prior to injection.

Hydrolytic stability

The amount of (1) was determined by an CatSO3 titration (complexation with LAS) immediately after making. This amount was in good agreement with the theoretical amount present. Result from CatSO3 titrations were in good agreement with results from titrations with Potassium Hydroxyde before and after saponification (this is the classical method to determine estervalues). The CatSO3 titration was preferred because it allowed more reliable and precise end-point determination. CatSO3 titrations were used to determine the amount of non-hydrolysed (1) after various intervals in time.

Results were as follows:

| %(1) | AGE | PH | Cat SO3 Acid estimated | Cat SO3 Acid Found | % Recovery |
|---|---|---|---|---|---|
| 5.8 | fresh | 2.85 | 0.68 | 0.40 | 59 |
| | 13 days at Amb. | 2.81 | | 0.36 | 53 |
| | 24 days at Amb. | 2.80 | | 0.33 | 49 |
| | 6 weeks at Amb. | 2.81 | | 0.33 | 49 |
| 5.8 | fresh | 3.13 | 0.68 | 0.47 | 69 |
| | 13 days at Amb. | 3.16 | | 0.45 | 66 |
| | 24 days at Amb. | 3.27 | | 0.45 | 66 |
| | 6 weeks at Amb. | 3.13 | | 0.45 | 66 |
| 5.8 | fresh | 3.39 | 0.68 | 0.68 | 100 |
| | 13 days at Amb. | 3.47 | | 0.68 | 100 |
| | 24 days at Amb. | 3.46 | | 0.64 | 94 |
| | 6 weeks at Amb. | 3.30 | | 0.61 | 90 |
| 5.8 | fresh | 3.88 | 0.68 | 0.69 | 10 |
| | 13 days at Amb. | 4.21 | | 0.69 | 101 |
| | 24 days at Amb. | 4.12 | | 0.69 | 101 |
| | 6 weeks at Amb. | 3.98 | | 0.69 | 101 |
| 5.8 | fresh | 4.23 | 0.68 | 0.72 | 106 |
| | 13 days at Amb. | 4.21 | | 0.72 | 106 |
| | 24 days at Amb. | 4.13 | | 0.72 | 106 |
| | 6 weeks at Amb. | 3.81 | | 0.70 | 103 |
| 5.8 | fresh | 4.40 | 0.68 | 0.71 | 104 |
| | 13 days at Amb. | 4.50 | | 0.66 | 97 |
| | 24 days at Amb. | 4.42 | | 0.64 | 94 |
| | 6 weeks at Amb. | 3.80 | | 0.51 | 75 |
| 5.8 | fresh | 5.36 | 0.68 | 0.65 | 96 |
| | 13 days at Amb. | 4.70 | | 0.62 | 91 |
| | 24 days at Amb. | 4.40 | | 0.56 | 82 |
| | 6 weeks at Amb. | 3.99 | | 0.54 | 79 |
| 5.8 | fresh | 5.97 | 0.68 | 0.57 | 84 |
| | 13 days at Amb. | 5.31 | | 0.56 | 82 |
| | 24 days at Amb. | 4.98 | | 0.53 | 78 |
| | 6 weeks at Amb. | 4.72 | | 0.53 | 78 |
| 5.8 | fresh | 7.51 | 0.68 | 0.54 | 79 |
| | 13 days at Amb. | 6.64 | | 0.53 | 78 |
| | 24 days at Amb. | 6.19 | | 0.50 | 74 |
| | 6 weeks at Amb. | 5.82 | | 0.48 | 71 |

The above results clearly show the criticality of pH for hydrolytic stability, and shows the excellent results obtained in the preferred pH range of 3.4 to 4.2.

The following shelf-stable compositions according to the invention are prepared as described in Example 1.

| | Examples II–VII | | | | | |
|---|---|---|---|---|---|---|
| | Ex II | Ex. III | Ex. IV | Ex. V | Ex. VI | Ex. VII |
| DTOEDMAC (1) | 14% | 2% | 10% | 16% | 20% | 8% |
| DTDMAC (2) | — | 4% | 10% | — | — | — |
| Amine (3) | — | 2% | — | 6% | — | 2% |
| PDMS (4) | — | 1% | — | 0.5% | 0.5% | — |
| GMS (5) | — | 0.5% | 1% | — | 0.5% | — |
| SRP (6) | — | — | 0.5% | — | 0.5% | 0.5% |
| Perfume | 0.8% | 0.5% | 0.8% | 0.7% | 0.8% | 0.3% |
| HCl to pH | 3.8 | 3.8 | 3.6 | 3.8 | 3.6 | 3.8 |
| Minors (7) & water | | | | balance | | |

(1) N;N—di(2-tallowyloxy-2-oxo-ethyl)-N,N—dimethylammonium chloride
(2) ditallowdimethylammonium chloride
(3) 1-tallowamidoethyl-2-tallowimidazoline or monotallowdipolyethoxyamine
(4) polydimethylsiloxane, having a viscosity of 800 centistokes
(5) glyceryl monostearate
(6) soil release polymer of Formula V herein
(7) $CaCl_2$, dye, bactericide.

We claim:

1. An aqueous fabric softening composition with excellent hydrolytic stability on storage, containing a rapidly biodegradable quaternary ammonium softening agent of the formula:

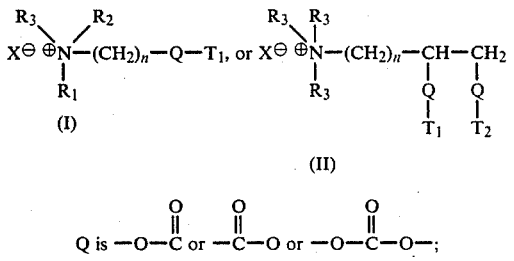

(I) (II)

Q is $-O-\overset{O}{\overset{\|}{C}}$ or $-\overset{O}{\overset{\|}{C}}-O$ or $-O-\overset{O}{\overset{\|}{C}}-O-$;

$R_1$ is $(CH_2)_n$—Q—$T_2$ or $T_3$;
$R_2$ is $(CH_2)_n$—Q—$T_4$ or $T_5$ or $R_3$;
$R_3$ is $C_1$–$C_4$ alkyl;
$T_1$, $T_2$, $T_3$, $T_4$, $T_5$ are (the same or different) $C_{12}$–$C_{22}$ alkyl or alkenyl;
n is an integer from 1 to 4; and
$X^{\ominus}$ is a softener-compatible anion, the composition having a pH, at 20° C., of from 2.5 to 4.2 upon dilution, in de-ionized water, to a concentration of 0.5% to 1% of said rapidly biodegradable quaternary ammonium.

2. A composition in accordance with claim 1 wherein said pH is from 3.4 to 4.2.

3. A composition in accordance with claim 1 wherein the rapidly biodegradable quaternary ammonium softening agent is N,N-di(2-tallowoyl-oxy-ethyl)N,N-dimethyl ammonium chloride.

4. An aqueous fabric softening composition in accordance with claim 1 comprising from 2% to 25% of said rapidly biodegradable quaternary ammonium compound.

5. A composition according to claim 1, further comprising from 2% to 25% of a conventional softening active compound selected from the group of quaternary ammonium salts having at least one acyclic aliphatic $C_{15}$–$C_{22}$ hydrocarbon group.

6. A composition according to claim 1 which further comprises from 1% to 40% of a di-(higher alkyl)cyclic amine of formula:

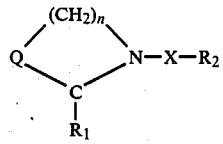

wherein n is 2 or 3; $R_1$ and $R_2$ are, independently, a $C_8$–$C_{30}$ alkyl or alkenyl; Q is CH or N; and X is either

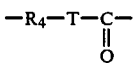

wherein T is O or $NR_5$, with $R_5$ being H or $C_1$–$C_4$ alkyl and $R_4$ being a divalent $C_1$–$C_3$ alkylene group or $(C_2H_4O)_m$, with m being a number of from 1 to 8, or X is $R_4$.

7. A composition according to claim 1 which further comprises from 0.1% to 10% of a predominantly linear di($C_1$–$C_5$)alkyl or $C_1$–$C_5$ alkylaryl siloxane in which the alkyl groups may be partially or wholly fluorinated and which may be substituted with cationic nitrogen groups, the siloxane having a viscosity at 25° C. of at least 100 centistokes and up to 100,000 centistokes.

8. A composition according to claim 7 wherein the siloxane is a polydimethyl siloxane.

9. A composition according to claim 1 which further comprises from 0.1% to 10% of a soil release agent.

10. A composition according to claim 9 wherein the soil release polymer is of the formula:

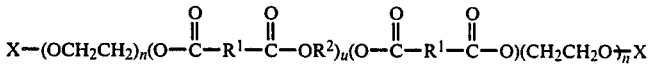

wherein $R^1$ is 1,4-phenylene; $R^2$ is 1,2-propylene; X is hydrogen; n is an integer of 6 to 120; u is generally an integer of 5, or less, with at least 20% to 40% of the material having u ranging from 3 to 5.

11. A composition according to claim 6 wherein n is 2 and $R_1$ and $R_2$ are, independently, $C_{11}$–$C_{22}$ alkyl.

12. A composition according to claim 11 wherein $R_1$ and $R_2$ are, independently, $C_{15}$–$C_{18}$ alkyl.

* * * * *